US005932777A

United States Patent [19]

Sughrue, II et al.

[11] Patent Number: 5,932,777

[45] Date of Patent: Aug. 3, 1999

[54] HYDROCARBON CONVERSION

[75] Inventors: Edward L. Sughrue, II, Bartlesville; Charles A. Drake, Nowata; Scott D. Love, Bartlesville, all of Okla.

[73] Assignee: Phillips Petroleum Company, Bartlesville, Okla.

[21] Appl. No.: 08/899,219

[22] Filed: Jul. 23, 1997

[51] Int. Cl.[6] ..... C07C 1/00

[52] U.S. Cl. ..... 585/322; 585/323; 585/412; 585/415; 585/467; 208/135; 208/63; 208/64

[58] Field of Search ..... 585/322, 323, 585/412, 467; 208/63, 64, 135

[56] References Cited

U.S. PATENT DOCUMENTS

| | | | |
|---|---|---|---|
| 3,813,330 | 5/1974 | Givens et al. | 208/66 |
| 3,827,867 | 8/1974 | Heinemann et al. | 48/211 |
| 3,827,968 | 8/1974 | Givens et al. | 208/49 |
| 3,894,934 | 7/1975 | Owen et al. | 208/78 |
| 4,066,531 | 1/1978 | Owen et al. | 208/120 |
| 4,097,367 | 6/1978 | Haag et al. | 208/135 |
| 4,188,282 | 2/1980 | Tabak et al. | 208/134 |
| 4,190,519 | 2/1980 | Miller | 208/137 |
| 4,263,132 | 4/1981 | Drehman et al. | 208/134 |
| 4,263,133 | 4/1981 | Drehman et al. | 208/134 |
| 4,341,622 | 7/1982 | Tabak et al. | 208/78 |
| 4,554,393 | 11/1985 | Liberts et al. | 585/322 |
| 4,765,883 | 8/1988 | Johnson | 208/78 |
| 4,861,932 | 8/1989 | Chen et al. | 585/412 |
| 4,879,424 | 11/1989 | Harandi | 585/322 |
| 4,927,525 | 5/1990 | Chu | 208/138 |
| 4,955,468 | 9/1990 | Lee | 203/53 |
| 4,975,178 | 12/1990 | Clem et al. | 208/65 |
| 5,032,232 | 7/1991 | Lee et al. | 203/51 |
| 5,227,555 | 7/1993 | Rhoe et al. | 585/322 |
| 5,258,563 | 11/1993 | Gosling et al. | 585/322 |
| 5,698,757 | 12/1997 | Wu | 585/488 |

OTHER PUBLICATIONS

Chen et al., Industrial & Engineering Chemistry Process Design and Development, vol. 25 (1986), pp. 151–155.

Chen, N.Y. & Yan, T. Y., M2 Forming–A Process for Aromatization of Light Hydrocarbons, Industrial & & Engineering Chemistry Process Design and Development, vol. 25 (1986), pp. 151–155.

Kirk–Othmer Encyclopedia of Chemical Technology vol. 9 (1980), pp. 696–709.

Kirk–Othmer Encyclopedia of Chemical Technology, vol. 17 (1982), pp. 217–221.

*Primary Examiner*—Helane Myers
*Attorney, Agent, or Firm*—Lucas K. Shay

[57] ABSTRACT

A hydrocarbon conversion process comprises: (1) contacting a hydrocarbon feed such as, for example, gasoline, with a catalyst under a sufficient condition to effect the conversion of the hydrocarbon to a product stream comprising aromatic hydrocarbons and olefins; (2) separating the product stream into a lights fraction comprising primarily hydrocarbons less than 6 carbon atoms per molecule, a middle fraction comprising $C_6$–$C_8$ aromatic hydrocarbons and non-aromatic hydrocarbons, and a $C_9$+ fraction comprising aromatic compounds; (3) separating the $C_6$–$C_8$ aromatic hydrocarbons from the middle fraction; and (4) separating hydrocarbons containing 5 or more carbons per molecule ($C_5$+ hydrocarbons) from the lights fraction. The $C_5$+ hydrocarbons can be combined with the hydrocarbon feed. The non-aromatic hydrocarbons can also be converted to olefins by a thermal cracking process. Furthermore, the middle fraction can also be obtained by reforming naphtha.

35 Claims, 3 Drawing Sheets

HYDROCARBON CONVERSION

FIELD OF THE INVENTION

This invention relates to a process for converting a hydrocarbon or a mixture of hydrocarbons to aromatic compounds and olefins.

BACKGROUND OF THE INVENTION

It is well known to those skilled in the art that aromatic hydrocarbons and olefins are each a class of very important industrial chemicals which find a variety of uses in petrochemical industry. It is also well known to those skilled in the art that catalytically cracking gasoline-range hydrocarbons produces lower olefins such as, for example, propylene; and aromatic hydrocarbons such as, for example, benzene, toluene, and xylenes (hereinafter collectively referred to as BTX) in the presence of catalysts which contain a zeolite. The product of this catalytic cracking process contains a multitude of hydrocarbons including unconverted $C_5$+ alkanes; lower alkanes such as methane, ethane, and propane; lower alkenes such as ethylene and propylene; $C_6$–$C_8$ aromatic hydrocarbons; and $C_9$+ aromatic compounds which contain 9 or more carbons per molecule.

Recent efforts to convert gasoline to more valuable petrochemical products have therefore focused on improving the conversion of gasoline to olefins and aromatic hydrocarbons (gasoline aromatization) by catalytic cracking in the presence of zeolite catalysts. For example, a gallium-promoted zeolite ZSM-5 has been used in the so-called Cyclar Process to convert a hydrocarbon to BTX. Olefins and aromatic hydrocarbons can be useful feedstocks for producing various organic compounds and polymers. However, the production yield of olefins to aromatic compounds produced by the gasoline aromatization process is generally not as high as one would desire. Therefore, development of a process for converting hydrocarbons to the more valuable olefins and BTX would be a significant contribution to the art and to the economy.

SUMMARY OF THE INVENTION

An object of the invention is to provide a process for converting a hydrocarbon to economically more valuable products. Another object of the invention is to provide a process for upgrading gasoline to aromatic hydrocarbons and olefins. Also an object of the invention is to provide a multi-step process for producing aromatic hydrocarbons and olefins from a hydrocarbon-containing feed. An advantage of the invention is that most less-desired by-products are recycled to the feed stream thereby improving the yield of the desired olefins and aromatic hydrocarbons.

According to a first embodiment of the invention, a process which can be used to convert a hydrocarbon comprising at least one non-aromatic hydrocarbon to aromatic hydrocarbons and olefins is provided. The process can comprise the steps of (1) contacting a hydrocarbon feed stream with a catalyst under a sufficient condition to effect the conversion of the hydrocarbon to a product stream comprising aromatic hydrocarbons and olefins wherein the hydrocarbon feed stream comprises at least one non-aromatic hydrocarbon; (2) separating the product stream into a lights fraction comprising primarily hydrocarbons less than 6 carbon atoms per molecule, a middle fraction comprising $C_6$–$C_8$ aromatic hydrocarbons, and a $C_9$+ fraction comprising aromatic compounds; (3) separating the $C_6$–$C_8$ aromatic hydrocarbons from the middle fraction; and (4) separating hydrocarbons containing 5 or more carbons per molecule (hereinafter referred to as $C_5$+ hydrocarbons) from the lights fraction.

According to a second embodiment of the invention, a process which can be used to convert a hydrocarbon comprising at least one non-aromatic hydrocarbon to aromatic hydrocarbons and olefins is provided. The process can comprise the steps of (1) contacting a hydrocarbon feed stream with a catalyst under a sufficient condition to effect the conversion of the hydrocarbon to a product stream comprising aromatic hydrocarbons and olefins wherein the hydrocarbon feed stream comprises at least one non-aromatic hydrocarbon; (2) separating the product stream into a lights fraction comprising primarily hydrocarbons less than 6 carbon atoms per molecule, a middle fraction comprising $C_6$–$C_8$ aromatic hydrocarbons, and a $C_9$+ fraction comprising aromatic compounds; (3) separating the $C_6$–$C_8$ aromatic hydrocarbons from the middle fraction thereby producing a non-aromatic hydrocarbons fraction; (4) introducing the non-aromatic hydrocarbons fraction into a thermal cracking reactor and converting therein the non-aromatic hydrocarbons into lower molecular weight hydrocarbons; (5) combining the lower molecular weight hydrocarbons with the lights fraction in step (2) to produce a combined stream; (6) separating the combined stream into a light olefins stream comprising ethylene and propylene, a first side stream comprising butanes, and a second side stream comprising $C_5$+ hydrocarbons.

According to a third embodiment of the invention, a process which can be used to convert a hydrocarbon comprising at least one non-aromatic hydrocarbon to aromatic hydrocarbons and olefins is provided. The process can comprise the steps of (1) introducing a first hydrocarbon feed into an aromatization reactor and contacting the first hydrocarbon feed stream with a catalyst under a sufficient condition to effect the conversion of the hydrocarbon to a first product stream comprising aromatic hydrocarbons and olefins wherein the first hydrocarbon feed stream comprises at least one non-aromatic hydrocarbon; (2) introducing a second hydrocarbon feed stream into a reforming reactor and contacting the second hydrocarbon feed with a Group VIII metal or a Group VIII metal-containing catalyst under a condition sufficient to produce a second product stream comprising aromatic hydrocarbons and olefins; (3) separating the first product stream into a lights fraction comprising primarily hydrocarbons less than 6 carbon atoms per molecule, a middle fraction comprising $C_6$–$C_8$ aromatic hydrocarbons, and a $C_9$+ fraction comprising aromatic compounds; (4) separating the second product stream into a lights fraction comprising primarily hydrocarbons less than 6 carbon atoms per molecule, a middle fraction comprising $C_6$–$C_8$ aromatic hydrocarbons, and a $C_9$+ fraction comprising aromatic compounds; (5) combining the middle fraction obtained in step (3) with the middle fraction obtained in step (4) to produce a combined middle fraction; (6) separating the $C_6$–$C_8$ aromatic hydrocarbons from the combined middle fraction thereby producing a non-aromatic hydrocarbons fraction; (7) introducing the non-aromatic hydrocarbons fraction into a thermal cracking reactor and converting therein the non-aromatic hydrocarbons into lower molecular weight hydrocarbons; (8) combining the lower molecular weight hydrocarbons with the lights fraction in steps (3) and (4) to produce a combined stream; (9) separating the combined stream into a light olefins stream comprising ethylene and propylene, a first side stream comprising primarily ethane and propane, a second side stream comprising butanes, and a bottoms stream comprising $C_5$+ hydrocarbons.

DETAILED DESCRIPTION OF THE INVENTION

Figure 1:
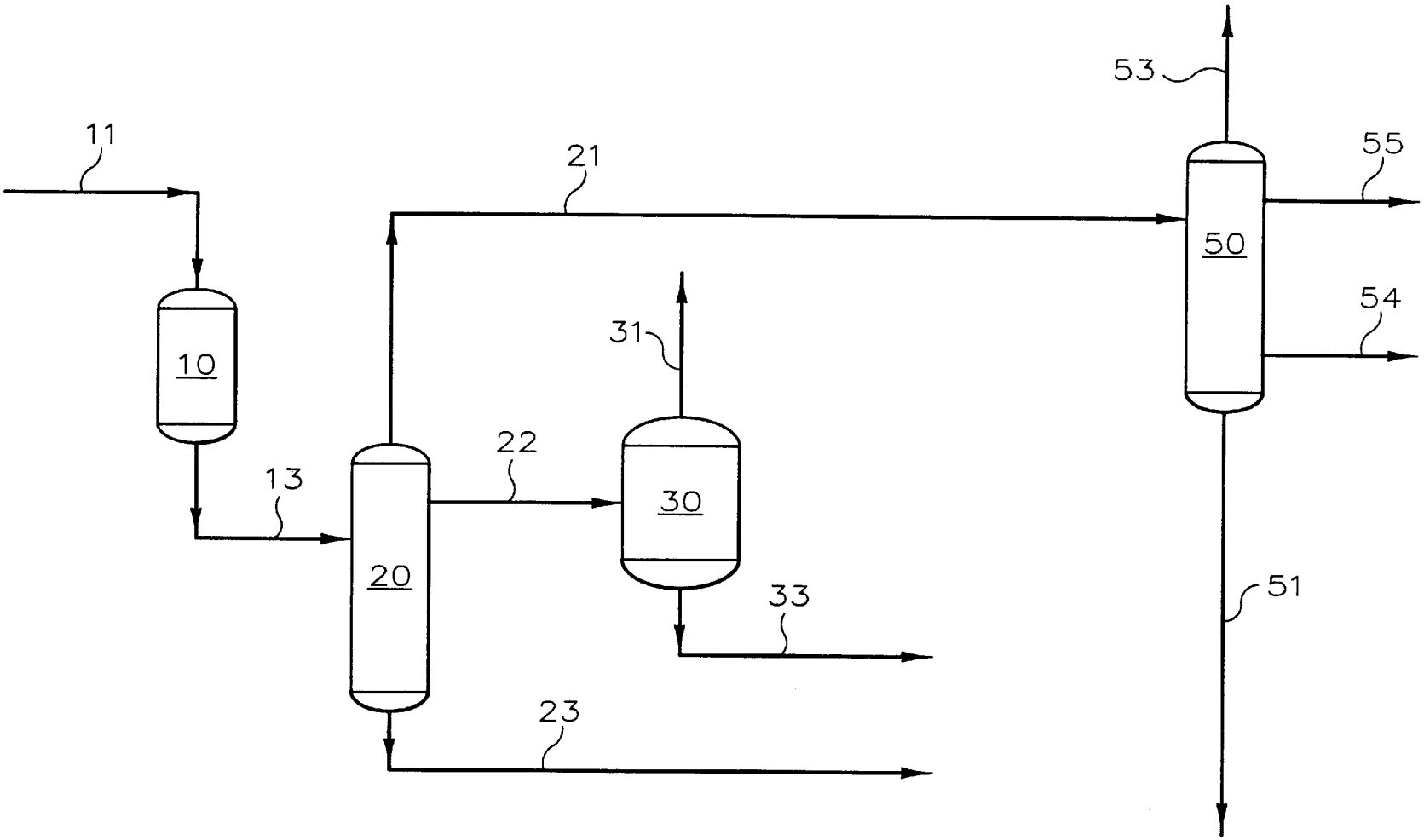
FIG. 1 illustrates a preferred combination process (comprising aromatization, aromatics extraction, and separations by fractional distillation) in accordance with the first embodiment of this invention.

According to the present invention, the term "hydrocarbon" refers to chemical compounds having the formula of $RH_z$ in which R is a hydrocarbyl radical which preferably can contain 1 to about 30, preferably 1 to about 25, and most preferably 4 to 16 carbon atoms per molecule; z is a number that fills the necessary valency of R; and the hydrocarbyl radicals can be alkyl radical, alkenyl radical, aryl radical, alkyl aryl radical, aryl alkyl radical, or combinations of two or more thereof and can be substituted or unsubstituted.

Any suitable hydrocarbon feedstock which comprises a hydrocarbon described above such as, for example, paraffins (alkanes) and/or olefins (alkenes) and/or naphthenes (cycloalkanes) can be used as the hydrocarbon feed in the invention. The presently preferred hydrocarbon feed is gasoline from a catalytic oil cracker, or naphtha. These feedstocks can also contain aromatic hydrocarbons. Generally, the content of paraffins exceeds the combined content of olefins, naphthenes and aromatics, if present. Examples of suitable, commercially available hydrocarbon feeds include, but are not limited to, gasolines from catalytic oil cracking (e.g., FCC) processes, pyrolysis gasolines from thermal hydrocarbon (e.g., ethane) cracking processes, reformates or combinations of two or more thereof. The preferred hydrocarbon feed is also a hydrocarbon feed suitable for use as at least a gasoline blend stock, generally having a boiling range at atmospheric conditions of about 30 to about 210° C. Specific examples of suitable feed materials are gasolines having the compositions listed hereinbelow in Table I (Example I).

According to the first embodiment of this invention, a process for upgrading a hydrocarbon feed can comprise, consist essentially of, or consist of the steps of:

(1) introducing a hydrocarbon feed stream comprising at least one non-aromatic hydrocarbon into an aromatization reactor, and contacting the feed stream with a catalyst, preferably a zeolite-containing catalyst, under effective reaction conditions to produce a reactor effluent, or product stream, comprising aromatic hydrocarbons and non-aromatic hydrocarbons (primarily alkanes and alkenes), wherein the non-aromatic hydrocarbons are present in the reactor effluent at a concentration lower than the concentration of the non-aromatic hydrocarbons in the hydrocarbon feed stream;

(2) introducing the reactor effluent into at least one first separator, i.e., one separator or a plurality of separators, or series of several fractional distillation units and separating the reactor effluent into (a) a lights fraction comprising primarily alkanes and alkenes containing 5 carbon atoms or less than 5 carbon atoms per molecule, (b) a middle fraction comprising primarily aromatic hydrocarbons containing 6 to 8 carbon atoms per molecule, and (c) a heavies ($C_9$+) fraction comprising hydrocarbons containing more than 8 carbon atoms per molecule;

(3) introducing the middle fraction (b) into an aromatic extraction unit and separating the middle fraction into a non-aromatics fraction and an aromatics fraction consisting essentially of benzene, toluene, ethylbenzene and xylenes (benzene, toluene, and xylenes are hereinafter referred to as BTX); and (4) introducing the lights fraction (a) into at least one second separator, preferably a series of several fractional distillation units, and separating the lights fraction into an overhead stream comprising primarily ethylene and propylene, a first side stream comprising primarily ethane and propane, and a second side stream comprising primarily butanes.

If a $C_5$+ stream comprising hydrocarbons containing 5 or more than 5 carbon atoms per molecule is obtained in step (4), it is preferred to combine this $C_5$+ stream with the hydrocarbon feed stream used in step (1) and to introduce the thus-obtained combined stream into the aromatization reactor in step (1).

Any suitable reacting vessels known to one skilled in the art which can be used to convert a non-aromatic hydrocarbon into an aromatic hydrocarbon or a mixture of aromatic hydrocarbons can be used as aromatization reactor. Because an aromatization reactor is well known to one skilled in the art, the description of which is omitted herein.

Any catalyst, preferably containing a zeolite, which is effective in the conversion of a non-aromatic hydrocarbon to an aromatic hydrocarbon and an olefin such as, for example, ethylene and propylene, can be employed in the aromatization contacting step of the invention. Preferably, the zeolite component of the catalyst has a constraint index, as defined in U.S. Pat. No. 4,097,367, in the range of about 0.4 to about 12, preferably about 2 to about 9. Generally, the molar ratio of $SiO_2$ to $Al_2O_3$ in the crystalline framework of the zeolite is at least about 3:1, preferably at least about 5:1, more preferably about 8:1 to about 200:1, and most preferably about 12:1 to about 60:1. Examples of preferred zeolites include, but are not limited to, ZSM-5, ZSM-8, ZSM-11, ZSM-12, ZSM-35, ZSM-38, and combinations of two or more thereof. Some of these zeolites are also known as "MFI or "Pentasil" zeolites. It is within the scope of this invention to use zeolites which have been steam-treated and/or acid-treated and/or contain a promoter selected from the group consisting of boron, phosphorus, sulfur, gallium, indium, zinc, chromium, silicon, germanium, tin, lead, lanthanides (including lanthanum), other promoters, or combinations of two or more thereof. Preferably the promoter is impregnated on the zeolite.

The catalyst generally also can contain an inorganic binder which is sometimes called matrix material. Any binders known to one skilled in the art can be used. Presently, it is preferred that a binder be selected from the group consisting of alumina, silica, alumina-silica, aluminum phosphate, clays such as bentonite, and combinations of two or more thereof. Optionally, other metal oxides, such as magnesia, ceria, thoria, titania, zirconia, hafnia, zinc oxide, and combinations of two or more thereof, which enhance the thermal stability and/or activity of the catalyst, can also be present in the catalyst. Preferably, hydrogenation promoters such as Ni, Pt, Pd, other Group VIII noble metals, Ag, Mo, W, or combinations of two or more thereof should essentially or substantially be absent from the catalyst. In other words, the total amount of these metals should preferably be less than about 0.1 weight %. Generally, the content of the zeolite component in the catalyst is about 1 to about 99, preferably about 5 to about 75, and most preferably 10 to 50 weight %, and the combined content of the above-listed inorganic binder and other metal oxide materials in the zeolite is about 1 to about 50 weight %. Generally, the zeolite component of the catalyst can be compounded with binders and subsequently shaped by any methods known to one skilled in the art such as pelletizing, extruding or tableting. Generally, the surface area of the catalyst is about 2 to about 150, preferably 5 to 100 $m^2/g$, and its particle size is about 1 to about 10 mm. The zeolite-containing catalysts are commercially available.

The hydrocarbon feed stream, or hydrocarbon-containing feed which preferably is combined with a recycle stream ($C_5$+ stream) from a separator used in step (4) as described above, generally can be and preferably is in the vaporized state when it is introduced into an aromatization reactor. The feed is then contacted in any suitable manner with the solid zeolite-containing catalyst contained in the aromatization reactor. Any suitable reactors, as disclosed above, known to one skilled in the art can be used. Step (1) can be carried out as a batch process step, as a semi-continuous process step, or preferably, as a continuous process step. In the latter operation, a solid catalyst bed or a moving catalyst bed or a fluidized catalyst bed can be employed. Any of these operational modes have advantages and disadvantages, and those skilled in the art will be able to select the one most suitable for a particular process, feed or catalyst. No significant amount of hydrogen gas is required to be introduced with the feed into the reactor zones of step (1). That is, no $H_2$ gas at all or only insignificant trace amounts of $H_2$ (e.g., less than about 1 ppm $H_2$), which do not significantly affect the aromatization process, are to be introduced into the aromatization reactor from an external source.

First process step (1) of the invention is generally carried out at a reaction temperature of 200 to about 1000° C., preferably about 300 to about 800° C., and most preferably 400 to 700° C.; under a reaction pressure of about 0 to about 1500 psig, preferably about 0 to about 1000 psig, and most preferably 0 to 500 psig; and a weight hourly space velocity ("WHSV") of the hydrocarbon feed of about 0.01 to about 200, preferably about 0.1 to about 100, and most preferably 0.1 to 50 gram feed per gram catalyst per hour. The term "weight hourly space velocity", as used herein, refers to the rate at which a hydrocarbon feed is charged to the reactor zone in grams per hour divided by the grams of catalyst contained within the reaction zone of the reactor to which the hydrocarbon feed is charged.

Separation steps (2) and (4) of the first embodiment of this invention, can be carried out with any suitable equipment at any suitable operating conditions known to one skilled in the art. The specific parameters of these separation steps generally depend on the compositions of the product or reactor effluent streams which are introduced into the separators, the temperature and flow rates of these streams, the desired compositions of the separated fractions produced in these separators, and the like. The preferred method for these separation steps is conventional fractional distillation. It is within the capabilities of persons possessing ordinary skills in this technology to select for each separation step the specific dimensions (width, height) of distillation columns, the type of trays or packing materials in these columns, the operating pressure within these columns, the temperature profiles with the columns, the number of plates or stages in these columns, the overhead reflux ratios, the reboiler reflux ratios, and the like. Numerous textbooks and handbooks on distillation technology are available, such as Kirk-Othmer Encyclopedia of Chemical Technology, Volume 7, Third Edition, 1979, pages 849–891, published by John Wiley and Sons, and "Elements of Fractional Distillation" by Clark Shove Robinson and Edwin Richard Gilliland, Fourth Edition, 1950, McGraw-Hill Book Company, Inc. disclosure of which are herein incorporated by reference.

The term "fractional distillation unit", as used herein, encompasses a distillation column, or a plurality of distillation columns, heat-exchangers and compressors, all designed to accomplish desired separations. Examples of such "fractional distillation units" include the so-called commercial "gas plants" or separation trains used for separating the light end products produced in commercial thermal alkane crackers, e.g., ethane stream crackers. The specific operating equipment and conditions for these "fractional distillation units" are well known to those skilled in the art and are omitted herein for the interest of brevity.

Aromatics extraction step (3) of the invention can be carried out in any suitable manner, with any suitable equipment and at any suitable operating conditions. Aromatics extraction can be carried out as a liquid-liquid extraction (presently preferred) or as an extractive distillation, as described in Kirk-Othmer's Encyclopedia of Chemical Technology, Volume 9, Third Edition, 1980, John Wiley and Sons, pages 672–721 (in particular pages 696–709) and in U.S. Pat. Nos. 4,955,468 and 5,032,232 (which provide additional references on liquid-liquid extraction and extractive distillation) disclosures of which are incorporated herein by reference. The presently preferred aromatics extraction is a liquid-liquid extraction. Suitable solvents which can be employed for aromatics extraction include, but are not limited to, sulfolane, tetraethylene glycol, dimethyl sulfoxide, N-methyl-2-pyrrolidone (NMP), N-mercaptoethyl-2-pyrrolidone, N-methyl-2-thiopyrrolidone, glycol/water mixtures, N-formylmorpholine, and combinations of two or more thereof. The presently preferred solvent is sulfolane. The solutions of extracted aromatics in these solvents which exit each aromatics extraction unit can be separated into substantially pure BTX, or $C_6$–$C_8$ aromatic hydrocarbons, and solvents (which is generally recycled to the extraction unit) in any suitable manner, such as by heating in a stripper in which the aromatic hydrocarbons are evaporated and subsequently condensed. Persons of ordinary skills in the art of aromatics extraction technology can choose, without undue experimentation, the most suitable solvent, equipment and operating parameters for extraction step (3).

According to the second embodiment of this invention, a process for upgrading hydrocarbon feeds comprises the steps of:

(1) introducing a hydrocarbon feed stream comprising at least one non-aromatic hydrocarbon into an aromatization reactor, and contacting said feed stream with a catalyst, preferably a zeolite-containing catalyst, under effective reaction conditions to produce a reactor effluent, or product stream, comprising aromatic hydrocarbons and non-aromatic hydrocarbons (primarily alkanes and alkenes), wherein the definition and scope of hydrocarbons are the same as disclosed above and the non-aromatic hydrocarbons are present in the reactor effluent at a concentration lower than the concentration of the non-aromatic hydrocarbons in the hydrocarbon feed stream;

(2) introducing the reactor effluent into at least one first separator (preferably a series of several fractional distillation units) and separating the reactor effluent into (a) a lights fraction comprising primarily alkanes and alkenes containing less than 6 carbon atoms per molecule, (b) a middle fraction comprising primarily aromatic hydrocarbon containing 6 to 8 carbon atoms per molecule and (c) a heavies ($C_9$+) fraction comprising hydrocarbons containing more than 8 carbon atoms per molecule;

(3) introducing the middle fraction (b) into an aromatic extraction unit and separating the middle fraction into a non-aromatics fraction and an aromatics fraction consisting essentially of BTX;

(4) introducing the non-aromatics fraction obtained in step (3) into a thermal cracking reactor (preferably a steam cracker) and converting the hydrocarbons contained in the non-aromatics fraction to a second product stream which comprises lower molecular weight hydrocarbons wherein the term "lower molecular weight hydrocarbons" refers to a hydrocarbon mixture comprising primarily alkanes and alkenes containing 2 to 4 carbon atoms per molecule;

(5) combining the second product stream from the thermal cracking reactor in step (4) with the lights fraction (a) obtained in step (2) to produce a combined stream; and (6) introducing the combined stream obtained in step (5) into at least one second separator (preferably a series of several fractional distillation units), and separating the combined stream into an overhead stream comprising primarily ethylene and propylene, a first side stream comprising primarily ethane and propane, a second side stream comprising primarily butanes, and a bottoms stream comprising hydrocarbons containing 5 or more than 5 carbon atoms per molecule.

In a preferred mode of this second embodiment of the invention, the first side stream obtained in step (6) is combined with the non-aromatic fraction obtained in step (3) and, optionally, also with a fresh alkane feed from an outside source to product a second combined stream which is introduced into the thermal cracking reactor used in step (4).

In another preferred mode of this second embodiment of the invention, the bottoms stream obtained in step (6) is combined with the hydrocarbon feed stream used in step (1) to product a third combined stream which is introduced into the aromatization reactor in step (1).

The process step (1) of the second embodiment of the invention can be carried out the same, or substantially the same, as that disclosed above for step (1) of the first embodiment of the invention.

Separating steps (2) and (6) of the second embodiment of the invention can be carried out by the same, or substantially the same, as the separation steps (2) and (4) disclosed above in the first embodiment of the invention.

The extraction of aromatic hydrocarbons, or aromatics extraction, of step (3) of the second embodiment of the invention can be carried out the same, or substantially the same, as the aromatics extraction (step (3)) of the first embodiment of the invention.

The thermal cracking step (4) of the second embodiment can be carried out in any suitable reactor at any suitable operating conditions. Thermal cracking (also referred to as pyrolysis) reactors and processes are well known and are widely used in commercial plants for producing ethylene and propylene from $C_2$–$C_8$ saturated hydrocarbons, such as ethane, propane, butanes, and the like. These reactors and processes are also described in the general technical literature, such as Kirk-Othmer Encyclopedia of Chemical Technology, Volume 17, Third Edition, 1982, John Wiley and Sons, pages 217–219, and in the patent literature, such as U.S. Pat. No. 5,284,994, column 3, disclosure of which are incorporated herein by reference.

Preferably, the hydrocarbon stream to be thermally cracked is admixed with steam before it is injected into the thermal cracker, generally at a steam to hydrocarbon mole ratio of about 0. 1:1 to about 3:1, preferably about 0.2:1 to about 1.6:1. Generally, the reaction temperature in the thermal cracker is in the range of about 1350° C. to about 1800° C., the residence time of the hydrocarbon/steam stream in the reactor is about 0.1 to about 1.5 seconds, and the pressure in the reactor is about 2 to about 40 psig. The thermally cracked olefin-rich product generally flows through filters (to remove coke particles from the gaseous product stream) and through condensing means (for removing high boiling materials from the gaseous product stream). Persons possessing ordinary skills in the art of thermal cracking can chose the most suitable equipment and optimal operating conditions for step (4).

According to the third embodiment of this invention, a process for upgrading hydrocarbon feeds comprises the steps of:

(1) introducing a first hydrocarbon feed stream comprising at least one non-aromatic hydrocarbon into an aromatization reactor, and contacting said first feed stream with a catalyst, preferably a zeolite-containing catalyst, under effective reaction conditions to produce a first product stream (reactor effluent) comprising aromatic hydrocarbons and non-aromatic hydrocarbons containing primarily alkanes and alkenes, wherein the definition and scope of hydrocarbon are the same as disclosed above in the first embodiment of the invention and the non-aromatic hydrocarbons are present in the first reactor effluent at a concentration lower than the concentration of the non-aromatic hydrocarbons in the first hydrocarbon feed stream;

(2) introducing a second hydrocarbon feed stream comprising at least one non-aromatic hydrocarbon, preferably a hydrotreated naphtha, into a reforming reactor, and contacting the second hydrocarbon feed with a Group VIII (Periodic Table of Elements; CRC Handbook of Chemistry and Physics, 67th edition, CRC Press, Inc., Boca Raton, Fla.) metal, or a Group VIII metal-containing, catalyst under an effective dehydrogenation/dehydrocyclization reaction condition to produce a second product stream (reactor effluent) comprising aromatic hydrocarbons and non-aromatic hydrocarbons (primarily alkanes, alkenes, cycloalkanes and cycloalkenes), wherein the definition and scope of hydrocarbon are the same as disclosed above; and unsaturated and cyclic non-aromatic hydrocarbons are present in the second reactor effluent at a concentration higher than the concentration of the unsaturated and cyclic non-aromatic hydrocarbons in the second hydrocarbon feed stream;

A hydrotreated naphtha is a fraction from a crude oil distillation which has subsequently been catalytically hydrotreated, primarily for desulfurization.

(3) introducing the first reactor effluent obtained in step (1) into at least one first separator (preferably a series of several fractional distillation units) and separating the first reactor effluent into (a) a lights fraction comprising primarily alkanes and alkenes containing less than 6 carbon atoms per molecule, (b) a middle fraction comprising primarily aromatic hydrocarbons containing 6–8 carbon atoms per molecule, and (c) a heavies ($C_9$+) fraction comprising hydrocarbons containing more than 8 carbon atoms per molecule;

(4) introducing the second reactor effluent obtained in step (2) into at least one second separator (preferably a series of several fractional distillation units) and separating the second reactor effluent into (i) a lights fraction comprising primarily alkanes and alkenes containing less than 6 carbon atoms per molecule, (ii) a middle fraction comprising primarily aromatic hydrocarbons containing 6–8 carbon atoms per molecule, and (iii) a heavies ($C_9$+) fraction comprising primarily hydrocarbons containing more than 8 carbon atoms;

(5) combining the middle fraction (a) obtained in step (3) with said middle fraction (ii) obtained in step (4) to product a combined middle fraction;

(6) introducing the combined middle fraction obtained in step (5) into an aromatics extraction unit and separating the combined stream into a non-aromatics fraction and an aromatics fraction consisting essentially of BTX;

(7) introducing the non-aromatics fraction obtained in step (6) into a thermal cracking reactor (preferably a steam cracker) and converting hydrocarbons contained in the non-aromatics fraction into lower molecular weight hydrocarbons which, as disclosed hereinabove in the first embodiment of the invention, comprises primarily alkanes and alkenes containing 2 to 4 carbon atoms per molecule;

(8) combining the reactor effluent from the thermal cracking reactor in step (7) with said lights fraction (a) obtained in step (3); and (9) introducing the combined stream obtained in step (8) into at least one third separator (preferably a series of several fractional distillation units), and separating the combined stream into an overhead stream comprising primarily ethylene and propylene, a first side stream comprising primarily ethane and propane, a second side stream comprising primarily butanes and butenes, and a bottoms stream comprising hydrocarbons containing 5 or more than 5 carbon atoms per molecule ($C_5$+ hydrocarbons).

In a preferred mode of this third embodiment of the invention, the first side stream obtained in step (9) is combined with the non-aromatics fraction obtained in step (3) and, optionally, also with a fresh alkane feed from an outside source to produce a second combined stream which is introduced into the thermal cracking reactor used in step (7).

In another preferred mode of the third embodiment of this invention, the first side stream obtained in step (9) is combined with the non-aromatics fraction obtained in step (3) and pentanes (from an outside source) to produce a third combined stream which is introduced into the thermal cracking reactor used in step (7).

In still another preferred mode of the third embodiment of this invention, the bottoms stream obtained in step (9) is combined with the first hydrocarbon feed stream used in step (1) to produce a fourth combined stream which is introduced into the aromatization reactor used in step (1).

In a further preferred mode of the third embodiment of this invention, the heavies fraction (c) obtained in step (3) is combined with the heavies fraction (iii) obtained in step (4) so as to obtain a combined $C_9$+ hydrocarbon product stream.

The process step (1) in the third embodiment of the invention can be carried out the same, or substantially the same, as the process step (1) of the first embodiment of the invention.

The separation steps (3), (4), and (9) of the third embodiment of the invention can be carried out the same, or substantially the same, as the separation steps (2) and (4) of the first embodiment of the invention.

Similarly, the aromatics extraction step (6) of the third embodiment of the invention can also be carried out the same, or substantially the same, as the aromatics extraction step (3) of the first embodiment of the invention.

The thermal cracking step (7) of third embodiment of the invention can be carried out the same, or substantially the same, as the thermal cracking step (4) of the second embodiment of the invention.

Reforming process step (2) in the third embodiment of this invention can be carried out with any suitable feed, in any suitable reactor, with any effective catalyst and at any effective reaction conditions. Since reforming is a process well known to one skilled in the art and is a commercially practiced refining operation (generally designed to enhance the octane rating of a hydrocarbon fuel), persons possessing ordinary skills in the art of reforming can choose the equipment, the catalysts and the operating conditions which are best suited for their particular feeds to obtain the most desirable products. Therefore, detailed description of reforming is omitted herein for the interest of brevity.

A preferred feedstock for reforming process step (2) is a naphtha which is frequently also referred to as heavy straight-run gasoline and generally boils in the range of about 180 to about 400° F. at atmospheric conditions. Naphtha is generally obtained by atmospheric distillation of crude oil. Another preferred feedstock is a hydrotreated naphtha, i.e., naphtha which has been contacted with hydrogen gas at an elevated temperature at about 300 to about 550° C. in the presence of a hydrotreating catalyst which generally contains Ni, Co, Mo, W, or combinations of two or more thereof which can also be supported on alumina, silica-alumina, titania-alumina, and the like. The preferred feedstocks for step (2) generally contain primarily alkanes (paraffins) containing 4–16 carbon atoms per molecule.

Reforming of naphthas and similar alkane-rich feedstocks comprises a combination of reactions, primarily hydrocracking, dehydrogenation and dehydrocyclization of alkanes (paraffins), dehydrogenation of cycloalkane intermediates to aromatic hydrocarbons, and isomerization of alkanes and of cyclic intermediates. Hydrogen gas is generally added to the reformer or reforming reactor which contains an effective reforming catalyst comprising a Group VIII metal (preferably Ni, Ru, Rh, Pd, Os, Ir, Pt), more preferably commercially available platinum on alumina, and platinum/rhenium on alumina materials. These alumina-supported catalysts frequently contain a halide such as chloride as an additional component. Other effective reforming catalysts are those comprising a Group VIII metal (preferably Pt) on a zeolite, such as zeolite X, zeolite Y, zeolite beta, zeolite ZSM-5, or combinations of two or more thereof. These zeolites are described in U.S. Pat. Nos. 4,975,178 and 4,927,525, disclosures of which are incorporated herein by reference. Generally, the Group VIII metal content in these reforming catalysts generally can be about 0.01 to about 10 weight %, preferably about 0.1 to about 5 weight %. Reforming catalysts are commercially available.

Reforming can be carried out under any effective conditions known to one skilled in the art. Typical reforming conditions can comprise a reaction temperature of about 300 to about 750° C., preferably about 400 to about 600° C. and most preferably 450 to 550° C.; a reaction pressure of about 50 to about 800 psig; a molar ratio of added hydrogen gas to hydrocarbon feed of about 0.1:1 to about 15:1, preferably about 1:1 to about 6:1; and a weight hourly space velocity ("WHSV") of about 0.5 to about 20 lb/lb/hour, preferably about 1.5 to about 10 lb/lb/hour, and most preferably 0.8 to 3.5 lb/lb/hour.

The following examples are presented to further illustrate this invention and should not be construed as unduly limiting the scope of this invention.

EXAMPLE I

This example illustrates a preferred embodiment of the combination process of this invention depicted in FIG. 1.

The preferred feed stream 11 is a gasoline fraction from a FCC cracker. Compositions of typical gasoline feeds are presented in Table I.

TABLE I

Gasoline Feed Composition (Weight %)

| Component | Broad Range | Narrow Range |
|---|---|---|
| Hydrogen | 0 | 0 |
| Methane | 0 | 0 |
| Ethane/Propane | 0 | 0 |
| Ethylene | 0 | 0 |
| Propylene | 0 | 0 |
| $C_4$ Alkanes | 0 | 0 |
| $C_4$ Alkenes | 0 | 0 |
| $C_6$-Non-Aromatics[1] | 20–50 | 30–35 |
| $C_6$–$C_9$ Non-Aromatics | 10–50 | 20–30 |
| Benzene | 0–10 | 1–4 |
| Toluene | 0–20 | 4–8 |
| Ethylbenzene | 0–10 | 1–4 |
| Xylenes | 0–30 | 5–12 |
| $C_9$ + Hydrocarbons[2] | 0–50 | 20–30 |

[1]Non-aromatic $C_4$, $C_5$ and $C_6$ hydrocarbons, primarily alkanes, alkenes and cycloalkanes.
[2]Complex mixture of alkanes, alkenes, cycloalkanes, cycloalkenes and aromatics containing 9 or more than 9 carbon atoms per molecule.

Feed stream 11 is introduced into a gasoline conversion reactor 10 (also referred to as gasoline conversion unit, GCU). Reactor 10 is a catalytic cracking reactor in which the gasoline feed is contacted with a zeolite-containing catalyst (preferably a catalyst containing a ZSM-5 or a similar zeolite) under an effective conversion condition. Reactor 10 can be a fluidized reactor, preferably a fixed bed reactor. The entire reactor effluent stream 13 is introduced into first fractional distillation unit 20 in which the reactor effluent 13 is separated into a lights fraction 21 comprising primarily hydrogen gas, $C_1$–$C_5$ paraffins and $C_2$–$C_5$ olefins; a middle fraction 22 comprising primarily BTX, some ethylbenzene and some $C_6$–$C_8$ paraffins; and a heavies fraction 23 comprising primarily $C_9$+ hydrocarbons having 9 or more carbon atoms per molecule.

The middle fraction 22 is introduced into an aromatics extraction unit 30 in which the middle fraction is contacted with a suitable solvent such as sulfolane or N-methyl-2-pyrrolidone or tetraethylene glycol or mixtures thereof in a counter-current operation to extract aromatic hydrocarbons. The formed extract is separated into aromatics and solvent by any well known means such as, for example, in a heated stripper. The extraction yields a substantially pure BTX product stream 33. The raffinate stream 31 exiting the extraction unit 30 comprises primarily paraffins containing 6 to 8 carbon atoms per molecule. The lights fraction 21 is introduced into second fractional distillation unit 50, preferably a "gas plant" as defined above in the first embodiment of the invention. The lights fraction is separated into an overhead fraction 53 comprising primarily ethylene, propylene and some hydrogen; a light paraffin sidedraw stream 55 comprising primarily ethane and propane; being combined with the raffinate stream 31; a $C_4$ hydrocarbon stream 54 comprising primarily butanes; and a bottoms stream 51 comprising primarily $C_5$+ paraffins which can be recycled and combined with feed stream 11, if desired. Frequently, bottoms stream 51 contains negligible amounts of $C_9$+ paraffins, and thus no recycling is required.

A material balance for the preferred combination process described in this example and depicted in FIG. 1 in a commercial-size plant operation is given in Table II. All numbers in Table II are flow rates (expressed in pounds per hour).

TABLE II

| Component | Stream 11 | Stream 13 | Stream 21 | Stream 22 | Stream 23 | Stream 31 |
|---|---|---|---|---|---|---|
| $H_2$ | 0 | 1,469 | 1,469 | 0 | 0 | 0 |
| Methane | 0 | 8,235 | 8,235 | 0 | 0 | 0 |
| Ethane | 0 | 9,441 | 9,441 | 0 | 0 | 0 |
| Ethylene | 0 | 41,332 | 41,332 | 0 | 0 | 0 |
| Propane | 0 | 21,033 | 21,033 | 0 | 0 | 0 |
| Propylene | 0 | 66,194 | 66,194 | 0 | 0 | 0 |
| Isobutane | 0 | 6,032 | 6,032 | 0 | 0 | 0 |
| n-Butane | 0 | 4,930 | 4,930 | 0 | 0 | 0 |
| Butenes | 0 | 29,845 | 29,845 | | | |
| Lights[1] | 0 | 40,808 | 0 | 40,808 | 0 | 40,808 |
| Non-Aromatics A[2] | See | 41,122 | 0 | 41,122 | 0 | 41,122 |
| Benzene | Table I | 18,463 | 0 | 18,463 | 0 | 0 |
| Toluene | | 57,697 | 0 | 57,697 | 0 | 0 |
| Ethylbenzene | | 4,249 | 0 | 4,249 | 0 | 0 |
| p-Xylene | | 41,752 | 0 | 41,752 | 0 | 0 |
| m-Xylene | | 0 | 0 | 0 | 0 | 0 |
| o-Xylene | | 14,052 | 0 | 14,052 | 0 | 0 |
| Non-Aromatics B[3] | | 23,394 | 0 | 23,394 | 0 | 23,394 |
| $C_9$+ Aromatics[4] | | 94,466 | 0 | 0 | 94,466 | 0 |
| Total | 524,514 | 524,514 | 188,511 | 241,537 | 94,466 | 105,324 |

| Component | Stream 33 | Stream 52 | Stream 53 | Stream 55 |
|---|---|---|---|---|
| $H_2$ | 0 | 0 | 1.469 | 0 |
| Methane | 0 | 0 | 8.235 | 0 |
| Ethane | 0 | 9,441 | 0 | 0 |
| Ethylene | 0 | 0 | 41,332 | 0 |
| Propane | 0 | 21,033 | 0 | 0 |
| Propylene | 0 | 0 | 66,194 | 0 |
| Isobutane | 0 | 0 | 0 | 6,032 |
| n-Butane | 0 | 0 | 0 | 4,930 |

TABLE II-continued

| | | | | |
|---|---|---|---|---|
| Butenes | 0 | 0 | 0 | 29,845 |
| Lights[1] | 0 | 0 | 0 | 0 |
| Non-Aromatics A[2] | 0 | 0 | 0 | 0 |
| Benzene | 18,463 | 0 | 0 | 0 |
| Toluene | 57,697 | 0 | 0 | 0 |
| Ethylbenzene | 4,249 | 0 | 0 | 0 |
| p-Xylene | 41,752 | 0 | 0 | 0 |
| m-Xylene | 0 | 0 | 0 | 0 |
| o-Xylene | 14,052 | 0 | 0 | 0 |
| Non-Aromatics B[3] | 0 | 0 | 0 | 0 |
| $C_9$+ Aromatics[4] | 0 | 0 | 0 | 0 |
| Total | 136,213 | 30,474 | 117,230 | 40,807 |

[1]$C_2$–$C_4$ hydrocarbons
[2]$C_5$–$C_8$ aliphatic and cycloaliphatic hydrocarbons
[3]$C_9$+ aliphatic and cycloaliphatic hydrocarbons
[4]Mainly tri- and tetramethylbenzenes

EXAMPLE II

Figure 2:
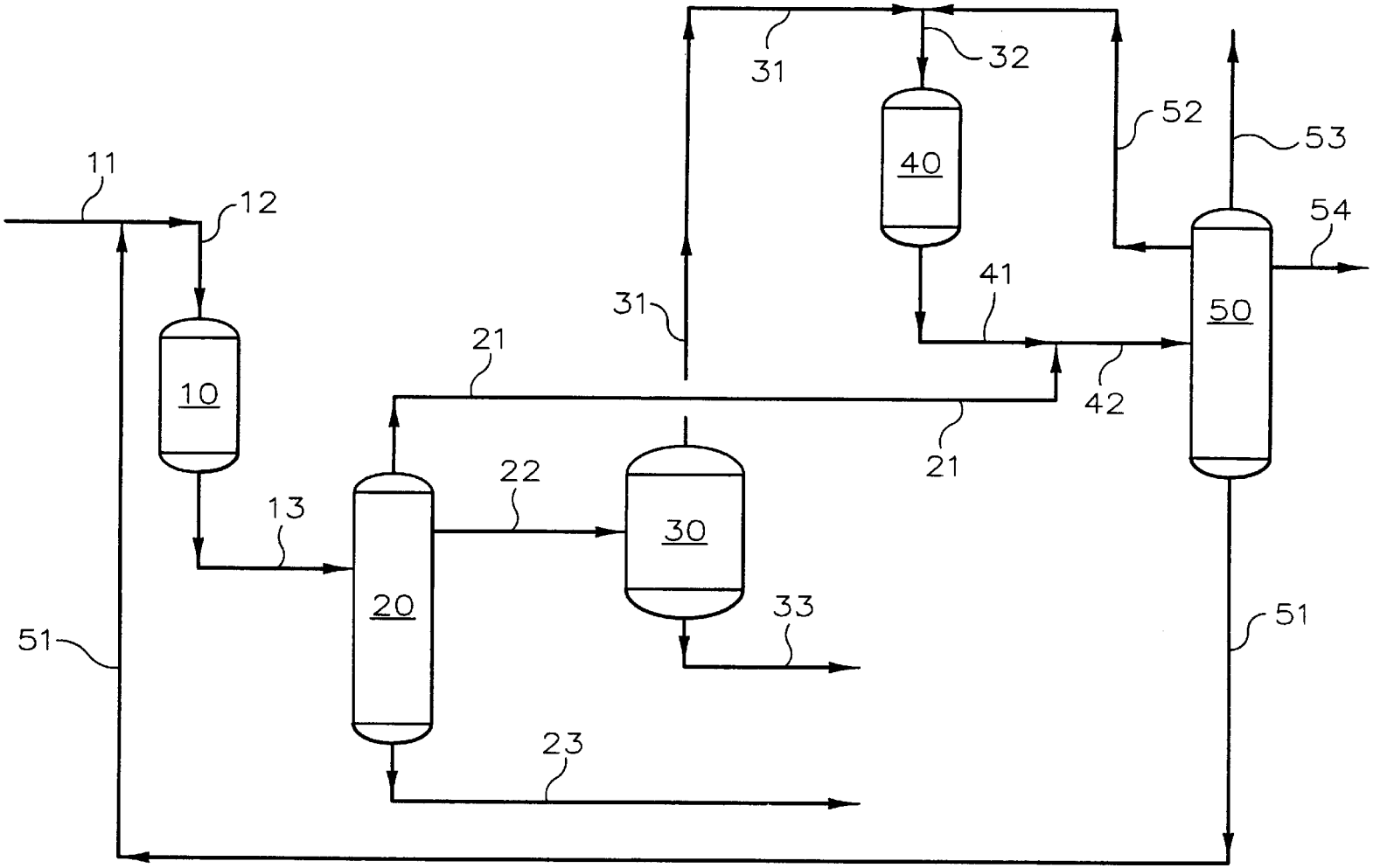
FIG. 2 illustrates a preferred combination process (comprising aromatization, aromatics extraction, thermal cracking, and separations by fractional distillation) in accordance with the third embodiment of this invention.

This example illustrates a preferred embodiment of the combination process depicted in FIG. 2.

Gasoline feed stream 11, preferably from a FCC cracker (see Table I for composition), is combined with recycle stream 51 comprising $C_5$+ hydrocarbons, as described hereinbelow. The combined stream 12 is introduced into aromatization reactor 10 as described in Example I in which the gasoline feed is contacted with a zeolite-containing catalyst (preferably a catalyst containing a ZSM-5 or a similar zeolite) under effective conversion conditions. The entire reactor effluent stream 13 is introduced into a first fractional distillation unit 20 in which the reactor effluent 13 is separated into a lights fraction 21 comprising primarily hydrogen gas, $C_1$–$C_5$ paraffins and $C_2$–$C_5$ olefins; a middle fraction 22 comprising primarily BTX, some ethylbenzene and some $C_6$–$C_8$ paraffins; and a heavies fraction 23 comprising primarily $C_9$+ aromatics, $C_9$+ paraffins and $C_9$+ olefins.

The middle fraction 22 is introduced into an aromatics extraction unit 30 in which the middle fraction is contacted with a suitable solvent for aromatics such as, for example, sulfolane, N-methyl-2-pyrrolidone or tetraethylene glycol, or mixtures thereof in a counter-current operation. The formed extract is separated into aromatics and solvent by any well known means such as, for example, in a heated stripper to yield a substantially pure BTX product stream 33. The raffinate stream 31 exiting the extraction unit 30 comprises primarily paraffins containing 6 to 8 carbon atoms per molecule.

This $C_6$–$C_8$ hydrocarbon stream 31 is combined with a light paraffin stream 52 obtained from a second separator as described hereinbelow to form combined stream 32 which is introduced into a thermal cracking reactor 40. Optionally, streams 31 and 52 can also be combined with a fresh alkane feed, which is not depicted in FIG. 2, from an outside source (e.g., ethane, propane or paraffin-containing NGL) to form the combined stream 32 which is introduced into a thermal cracking reactor 40. The thermally cracked product 41 exiting reactor 40 is combined with the lights fraction 21 exiting fractional distillation unit 20 to form combined stream 42. This stream 42 is introduced into a second fractional distillation unit 50 as described in Example I and separated into an overhead fraction 53 comprising primarily ethylene, propylene and some hydrogen; a light paraffin sidedraw stream 52 comprising primarily ethane and propane; and being combined with the raffinate stream 31 described above; a $C_4$ hydrocarbon sidedraw stream 54 comprising primarily butanes; and a bottoms stream 51 comprising primarily $C_5$+ paraffins and being recycled and combined with feed stream 11 as described above.

A material balance for the preferred combination process described in this example and depicted in FIG. 2 in a commercial-size plant operation is given in Table III. All numbers in Table III are flow rates (expressed in pounds per hour).

TABLE III

| Component | Stream 11 | Stream 12 | Stream 13 | Stream 21 | Stream 22 | Stream 23 | Stream 31 |
|---|---|---|---|---|---|---|---|
| $H_2$ | 0 | 0 | 1,517 | 1,517 | 0 | 0 | 0 |
| Methane | 0 | 0 | 8,505 | 8,505 | 0 | 0 | 0 |
| Ethane | 0 | 0 | 9,751 | 9,751 | 0 | 0 | 0 |
| Ethylene | 0 | 0 | 42,688 | 42,688 | 0 | 0 | 0 |
| Propane | 0 | 0 | 21,723 | 21,723 | 0 | 0 | 0 |
| Propylene | 0 | 0 | 68,366 | 68,366 | 0 | 0 | 0 |
| Isobutane | 0 | 0 | 6,230 | 6,230 | 0 | 0 | 0 |
| n-Butane | 0 | 0 | 5,092 | 5,092 | 0 | 0 | 0 |
| Butenes | 0 | 0 | 30,824 | 30,824 | 0 | 0 | 0 |
| Lights[1] | 0 | 0 | 42,146 | 0 | 42,146 | 0 | 42,146 |
| Non-Aromatics A[2] | See | See | 42,471 | 0 | 42,471 | 0 | 42,471 |
| Benzene | Table I | Table I | 19,069 | 0 | 19,069 | 0 | 0 |
| Toluene | | and | 59,590 | 0 | 59,590 | 0 | 0 |
| Ethylbenzene | | Stream 51 | 4,388 | 0 | 4,388 | 0 | 0 |
| p-Xylene | | | 43,121 | 0 | 43,121 | 0 | 0 |
| m-Xylene | | | 0 | 0 | 0 | 0 | 0 |

TABLE III-continued

| | | | | | | | |
|---|---|---|---|---|---|---|---|
| o-Xylene | | | 14,518 | 0 | 14,518 | 0 | 0 |
| Non-Aromatics B[3] | | | 24,161 | 0 | 24,161 | 0 | 24,161 |
| $C_9$+ Aromatics[4] | | | 97,565 | 0 | 0 | 97,565 | 0 |
| Total | 524,518 | 541,725 | 541,725 | 194,696 | 249,464 | 97,565 | 108,778 |
| Component | Stream 32 | Stream 33 | Stream 41 | Stream 42 | Stream 51 | Stream 52 | Stream 53 | Stream 54 |
| $H_2$ | 0 | 0 | 1,742 | 3,259 | 0 | 0 | 3,259 | 0 |
| Methane | 0 | 0 | 26,031 | 34,536 | 0 | 0 | 34,536 | 0 |
| Ethane | 9,751 | 0 | 0 | 9,751 | 0 | 9,751 | 0 | 0 |
| Ethylene | 0 | 0 | 57,497 | 100,185 | 0 | 0 | 100,185 | 0 |
| Propane | 21,723 | 0 | 0 | 21,723 | 0 | 21,723 | 0 | 0 |
| Propylene | 0 | 0 | 27,173 | 95,539 | 0 | 0 | 95,539 | 0 |
| Isobutane | 0 | 0 | 0 | 6,230 | 0 | 0 | 0 | 6,230 |
| n-Butane | 0 | 0 | 127 | 5,219 | 0 | 0 | 0 | 5,219 |
| Butenes | 0 | 0 | 10,475 | 41,299 | 0 | 0 | 0 | 41,299 |
| Lights[1] | 42,146 | 0 | 338 | 338 | 338 | 0 | 0 | 0 |
| Non-Aromatics A[2] | 42,471 | 0 | 8,416 | 8,416 | 8,416 | 0 | 0 | 0 |
| Benzene | 0 | 19,069 | 3,401 | 3,401 | 3,401 | 0 | 0 | 0 |
| Toluene | 0 | 59,590 | 1,777 | 1,777 | 1,777 | 0 | 0 | 0 |
| Ethylbenzene | 0 | 4,388 | 151 | 151 | 151 | 0 | 0 | 0 |
| p-Xylene | 0 | 43,121 | 0 | 0 | 0 | 0 | 0 | 0 |
| m-Xylene | 0 | 0 | 0 | 0 | 0 | 0 | 0 | 0 |
| o-Xylene | 0 | 14,518 | 0 | 0 | 0 | 0 | 0 | 0 |
| Non Aromatics B[3] | 24,161 | 0 | 2,904 | 2,904 | 2,904 | 0 | 0 | 0 |
| $C_9$+ Aromatics[4] | 0 | 0 | 221 | 221 | 221 | 0 | 0 | 0 |
| Total | 140,252 | 140,686 | 140,253 | 334,949 | 17,208 | 31,474 | 233,519 | 52,748 |

[1]$C_2$–$C_4$ hydrocarbons
[2]$C_5$–$C_8$ aliphatic and cycloaliphatic hydrocarbons
[3]$C_9$+ aliphatic and cycloaliphatic hydrocarbons
[4]Mainly tri- and tetramethylbenzenes

EXAMPLE III

Figure 3:
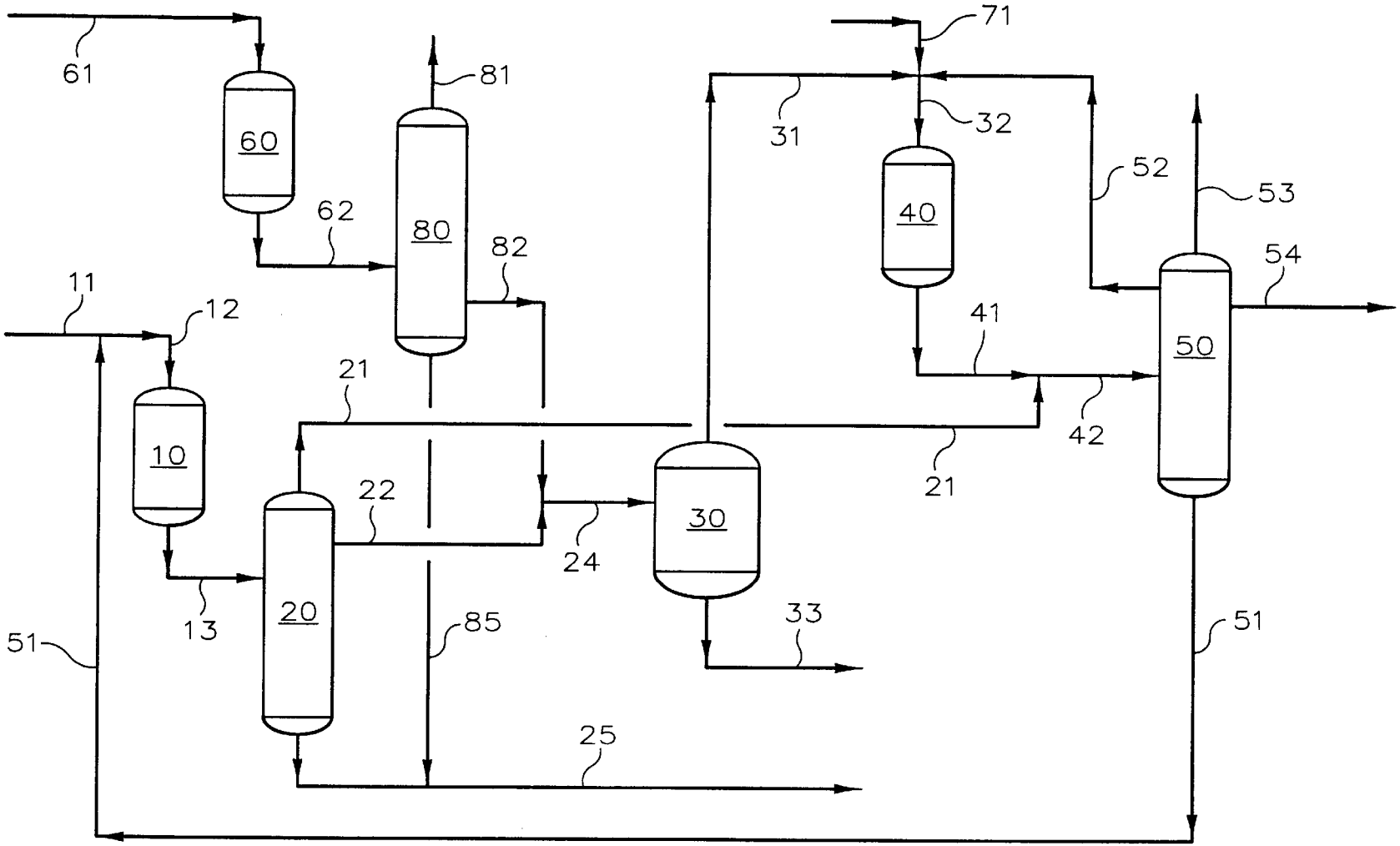
FIG. 3 illustrates a preferred combination process (comprising aromatization, reforming, aromatics extraction, thermal cracking and separations by fractional distillation), in accordance with the second embodiment of this invention.

This example illustrates a preferred embodiment of the combination process depicted in FIG. 3.

Gasoline feed stream 11, preferably from a FCC cracker (see Table I for compositions), is combined with recycle stream 51 comprising $C_5$+ hydrocarbons, described hereinbelow. The combined stream 12 is introduced into aromatization reactor 10 as described in Example I in which the gasoline feed is contacted with a zeolite-containing catalyst (preferably a catalyst containing a ZSM-5 or a similar zeolite) under effective conversion conditions. The entire reactor effluent stream 13 is introduced into a first fractional distillation unit 20 in which the reactor effluent 13 is separated into a lights fraction 21 comprising primarily hydrogen gas, $C_1$–$C_5$ paraffins and $C_2$–$C_5$ olefins; a middle fraction 22 comprising primarily BTX, some ethylbenzene and some $C_6$–$C_8$ paraffins; and a heavies fraction 23 comprising primarily $C_9$+ aromatics, $C_9$+ paraffins and $C_9$+ olefins.

Naphtha feed stream 61 which can have previously been hydrotreated is introduced, generally together with hydrogen gas as cofeed, into reformer 60 in which the naphtha feed is contacted with an effective reforming catalyst under effective reforming, i.e., dehydrogenation/dehydrocyclization, conditions. Reformer product stream 62 is introduced into a second fractional distillation unit 80 in which stream 62 is separated into a middle fraction 82 comprising primarily BTX aromatics, some ethylbenzene and some $C_6$–$C_8$ paraffins; a heavies fraction 85 comprising primarily $C_9$+ olefins), and a lights fraction 81 comprising primarily $C_1$–$C_4$ paraffins and $C_2$–$C_4$ olefins (generally used as a NGL feed or as a feedstock for thermal crackers). Heavies fraction 85 is combined with heavies fraction 23 to form stream 25 which comprises primarily hydrocarbons containing 9 or more carbon atoms per molecule.

Middle fraction 22 and middle fraction 82 are combined to form a combined stream 24 that is introduced into an aromatics extraction unit 30 in which the combined stream is contacted with a suitable solvent for aromatics such as, for example, sulfolane, N-methyl-2-pyrrolidone, tetraethylene glycol, and the like or mixtures thereof in a counter-current operation. The formed extract is separated into aromatics and solvent by any well known means such as, for example, in a heated stripper to yield a substantially pure BTX product stream 33. The raffinate stream 31 exiting the extraction unit 30 comprises primarily paraffins containing 6–8 carbon atoms per molecule.

This $C_6$–$C_8$ hydrocarbon stream 31 is combined with a light paraffin stream 52 from a second separator described hereinbelow and with a pentane stream 71 from an outside source to form a combined stream 32 which is introduced into a thermal cracking reactor 40. Optionally, streams 31 and 52 can also be combined with another fresh alkane feed from another outside source (e.g., ethane, propane, or paraffin-containing NGL such as stream 81 ) to form the combined stream 32 which is introduced into a thermal cracking reactor 40. The thermally cracked product 41 exiting reactor 40 is combined with the lights fraction 21 described above (exiting fractional distillation unit 20) to form a combined stream 42. This stream 42 is introduced into a second fractional distillation unit 50 and separated into an overhead fraction 53 comprising primarily ethylene, propylene and some hydrogen; a light paraffin sidedraw stream 52, comprising primarily ethane and propane, which is combined with the raffinate stream 31, as described hereinabove; a $C_4$ hydrocarbon sidedraw stream 54 comprising primarily butanes; and a bottoms stream 51 comprising primarily $C_5$+ paraffins and being recycled and combined with feed stream 11 as described above.

A material balance for the preferred combination process described in this example and depicted in FIG. 3 in a commercial-size plant operation is given in Table IV. All numbers in Table IV are flow rates (expressed in pounds per hour).

TABLE IV

| Component | Stream 11 | Stream 12 | Stream 13 | Stream 21 | Stream 22 | Stream 23 | Stream 24 |
|---|---|---|---|---|---|---|---|
| $H_2$ | 0 | 0 | 1,606 | 1,606 | 0 | 0 | 0 |
| Methane | 0 | 0 | 9,008 | 9,008 | 0 | 0 | 0 |
| Ethane | 0 | 0 | 10,327 | 10,327 | 0 | 0 | 0 |
| Ethylene | 0 | 0 | 45,210 | 45,210 | 0 | 0 | 0 |
| Propane | 0 | 0 | 23,006 | 23,006 | 0 | 0 | 0 |
| Propylene | 0 | 0 | 74,404 | 74,404 | 0 | 0 | 0 |
| Isobutane | 0 | 0 | 6,598 | 6,598 | 0 | 0 | 0 |
| n-Butane | 0 | 0 | 5,393 | 5,393 | 0 | 0 | 0 |
| Butenes | 0 | 0 | 32,645 | 32,645 | 0 | 0 | 0 |
| Lights[1] | 0 | 0 | 44,636 | 0 | 44,636 | 0 | 90,903 |
| Non-Aromatics A[2] | See | See | 44,980 | 0 | 44,980 | 0 | 58,034 |
| Benzene | Table I | Table I | 20,198 | 0 | 20,198 | 0 | 44,282 |
| Toluene | | and | 63,110 | 0 | 63,110 | 0 | 133,090 |
| Ethylbenzene | | Stream 51 | 4,647 | 0 | 4,647 | 0 | 79,564 |
| p-Xylene | | | 45,669 | 0 | 45,669 | 0 | 45,669 |
| m-Xylene | | | 0 | 0 | 0 | 0 | 0 |
| o-Xylene | | | 15,376 | 0 | 15,376 | 0 | 15,376 |
| Non-Aromatics B[3] | | | 25,588 | 0 | 25,588 | 0 | 80,532 |
| $C_9$+ Aromatics[4] | | | 103,328 | 0 | 0 | 103,328 | 0 |
| Total | 526,527 | 575,729 | 575,729 | 208,197 | 264,204 | 103,328 | 547,540 |

| Component | Stream 25 | Stream 31 | Stream 32 | Stream 33 | Stream 41 | Stream 42 | Stream 51 | Stream 52 |
|---|---|---|---|---|---|---|---|---|
| $H_2$ | 0 | 0 | 0 | 0 | 4,164 | 5,770 | 0 | 0 |
| Methane | 0 | 0 | 0 | 0 | 64,575 | 73,583 | 0 | 0 |
| Ethane | 0 | 0 | 10,327 | 0 | 0 | 10,327 | 0 | 10,327 |
| Ethylene | 0 | 0 | 0 | 0 | 150,503 | 195,713 | 0 | 0 |
| Propane | 0 | 0 | 23,006 | 0 | 0 | 23,006 | 0 | 23,006 |
| Propylene | 0 | 0 | 0 | 0 | 74,369 | 146,773 | 0 | 0 |
| Isobutane | 0 | 0 | 0 | 0 | 0 | 6,598 | 0 | 0 |
| n-Butane | 0 | 0 | 0 | 0 | 308 | 5,701 | 0 | 0 |
| Butenes | 0 | 0 | 0 | 0 | 29,974 | 62,619 | 0 | 0 |
| Lights[1] | 0 | 90,903 | 90,903 | 0 | 1,037 | 1,037 | 1,037 | 0 |
| Non-Aromatics A[2] | 0 | 58,034 | 168,334 | 0 | 25,207 | 25,207 | 25,207 | 0 |
| Benzene | 0 | 0 | 0 | 44,282 | 8,750 | 8,750 | 8,750 | 0 |
| Toluene | 0 | 0 | 0 | 133,090 | 3,810 | 3,810 | 3,810 | 0 |
| Ethylbenzene | 0 | 0 | 0 | 79,564 | 503 | 503 | 503 | 0 |
| p-Xylene | 0 | 0 | 0 | 45,669 | 0 | 0 | 0 | 0 |
| m-Xylene | 0 | 0 | 0 | 0 | 0 | 0 | 0 | 0 |
| o-Xylene | 0 | 0 | 0 | 15,376 | 0 | 0 | 0 | 0 |
| Non Aromatics B[3] | 0 | 80,532 | 80,532 | 0 | 9,164 | 9,164 | 9,164 | 0 |
| $C_9$+ Aromatics[4] | 157,225 | 0 | 0 | 0 | 737 | 737 | 737 | 0 |
| Total | 157,225 | 229,469 | 373,102 | 317,981 | 373,101 | 579,298 | 49,202 | 33,333 |

| Component | Stream 53 | Stream 54 | Stream 61[5] | Stream 62 | Stream 64 | Stream 65 | Stream 66 | Stream 71 |
|---|---|---|---|---|---|---|---|---|
| $H_2$ | 5,770 | 0 | | 7,032 | 0 | 0 | 7,032 | 0 |
| Methane | 73,583 | 0 | | 8,415 | 0 | 0 | 8,415 | 0 |
| Ethane | 0 | 0 | | 1,272 | 0 | 0 | 1,272 | 0 |
| Ethylene | 195,713 | 0 | | 0 | 0 | 0 | 0 | 0 |
| Propane | 0 | 0 | | 3,778 | 0 | 0 | 3,778 | 0 |
| Propylene | 146,773 | 0 | | 0 | 0 | 0 | 0 | 0 |
| Isobutane | 0 | 6,598 | | 9,201 | 0 | 0 | 9,201 | 0 |
| n-Butane | 0 | 5,701 | | 7,181 | 0 | 0 | 7,181 | 0 |
| Butenes | 0 | 62,619 | | 0 | 0 | 0 | 0 | 0 |
| Lights[1] | 0 | 0 | | 46,267 | 46,267 | 0 | 0 | 0 |
| Non-Aromatics A[2] | 0 | 0 | | 13,053 | 13,053 | 0 | 0 | 0 |
| Benzene | 0 | 0 | | 24,087 | 24,087 | 0 | 0 | 110,300 |
| Toluene | 0 | 0 | | 69,980 | 69,980 | 0 | 0 | 0 |
| Ethylbenzene | 0 | 0 | | 74,917 | 74,917 | 0 | 0 | 0 |
| p-Xylene | 0 | 0 | | 0 | 0 | 0 | 0 | 0 |
| m-Xylene | 0 | 0 | | 0 | 0 | 0 | 0 | 0 |
| o-Xylene | 0 | 0 | | 0 | 0 | 0 | 0 | 0 |
| Non Aromatics B[3] | 0 | 0 | | 54,944 | 54,944 | 0 | | |
| $C_9$+ Aromatics[4] | 0 | 0 | | 53,897 | 0 | 53,897 | 0 | 0 |
| Total | 421,839 | 74,918 | 374,024 | 374,024 | 283,248 | 53,897 | 36,879 | 110,300 |

[1] $C_2$–$C_4$ hydrocarbons
[2] $C_5$–$C_8$ aliphatic and cycloaliphatic hydrocarbons
[3] $C_9$+ aliphatic and cycloaliphatic hydrocarbons
[4] Mainly tri- and tetramethylbenzenes
[5] Contains about 52 weight-% paraffins, about 34 weight-% naphthenes, and aromatic as the remainder That which is claimed is:

1. A process comprising:

(1) contacting a hydrocarbon feed stream with a catalyst under a sufficient condition to effect the conversion of said hydrocarbon to a product stream comprising aromatic hydrocarbons and olefins wherein said hydrocarbon feed stream comprises at least one non-aromatic hydrocarbon;

(2) separating said product stream into a lights fraction, a middle fraction comprising $C_6$–$C_8$ aromatic hydrocarbons and non-aromatic hydrocarbons, and a $C_9$+ fraction comprising aromatic compounds; and (3) separating said $C_6$–$C_8$ aromatic hydrocarbons from said non-aromatic hydrocarbons thereby producing a non-aromatic hydrocarbons fraction.

2. A process according to claim 1 further comprising the step of separating $C_5$+ hydrocarbons from said lights fraction.

3. A process according to claim 2 further comprising the step of combining said $C_5$+ hydrocarbons with said hydrocarbon feed.

4. A process according to claim 1 further comprising the steps of:

(1) introducing said non-aromatic hydrocarbons fraction into a thermal cracking reactor; and (2) converting said non-aromatic hydrocarbons into lower molecular weight hydrocarbons.

5. A process according to claim 3 further comprising the steps of:

(1) introducing said non-aromatic hydrocarbons fraction into a thermal cracking reactor; and (2) converting said non-aromatic hydrocarbons into lower molecular weight hydrocarbons.

6. A process according to claim 4 further comprising:

(1) combining said lower molecular weight hydrocarbons with said lights fraction in step (2) of claim 1 to form a combined stream; and (2) separating ethylene and propylene from said combined stream.

7. A process according to claim 5 further comprising:

(1) combining said lower molecular weight hydrocarbons with said lights fraction in step (2) of claim 1 to form a combined stream; and (2) separating ethylene and propylene from said combined stream.

8. A process according to claim 1 wherein said hydrocarbon feed is gasoline.

9. A process according to claim 4 wherein said hydrocarbon feed is gasoline.

10. A process according to claim 9 further comprising:

(1) combining said lower molecular weight hydrocarbons with said lights fraction in step (2) of claim 1 to form a combined stream; and (2) separating ethylene and propylene from said combined stream.

11. A process according to claim 1 comprising the steps of:

(1) contacting a hydrocarbon feed stream with a catalyst under a sufficient condition to effect the conversion of said hydrocarbon to a product stream comprising aromatic hydrocarbons and olefins wherein said hydrocarbon feed stream comprises at least one non-aromatic hydrocarbon;

(2) separating said product stream into a lights fraction comprising primarily hydrocarbons less than 6 carbon atoms per molecule, a middle fraction comprising $C_6$–$C_8$ aromatic hydrocarbons, and a $C_9$+ fraction comprising aromatic compounds;

(3) separating said $C_6$–$C_8$ aromatic hydrocarbons from the middle fraction thereby producing a non-aromatic hydrocarbons fraction;

(4) introducing said non-aromatic hydrocarbons fraction into a thermal cracking reactor and converting therein said non-aromatic hydrocarbons into lower molecular weight hydrocarbons;

(5) combining said lower molecular weight hydrocarbons with said lights fraction in step (2) to produce a combined stream; and (6) separating said combined stream into a light olefins stream comprising ethylene and propylene, a first side stream comprising butanes, and a second side stream comprising $C_5$+ hydrocarbons.

12. A process according to claim 11 wherein said hydrocarbon feed is gasoline.

13. A process according to claim 1 comprising the steps of:

(1) introducing a first hydrocarbon feed into an aromatization reactor and contacting said first hydrocarbon feed stream with a catalyst under a sufficient condition to effect the conversion of said hydrocarbon to a first product stream comprising aromatic hydrocarbons and olefins wherein said first hydrocarbon feed stream comprises at least one non-aromatic hydrocarbon;

(2) introducing a second hydrocarbon feed stream into a reforming reactor and contacting said second hydrocarbon feed with a Group VIII metal or a Group VIII metal-containing catalyst under a condition sufficient to produce a second product stream comprising aromatic hydrocarbons and olefins;

(3) separating said first product stream into a lights fraction comprising primarily hydrocarbons less than 6 carbon atoms per molecule, a middle fraction comprising $C_6$–$C_8$ aromatic hydrocarbons, and a $C_9$+ fraction comprising aromatic compounds;

(4) separating said second product stream into a lights fraction comprising primarily hydrocarbons less than 6 carbon atoms per molecule, a middle fraction comprising $C_6$–$C_8$ aromatic hydrocarbons, and a $C_9$+ fraction comprising aromatic compounds;

(5) combining said middle fraction obtained in step (3) with said middle fraction obtained in step (4) to produce a combined middle fraction;

(6) separating said $C_6$–$C_8$ aromatic hydrocarbons from said combined middle fraction thereby producing a non-aromatic hydrocarbons fraction;

(7) introducing said non-aromatic hydrocarbons fraction into a thermal cracking reactor and converting said non-aromatic hydrocarbons into lower molecular weight hydrocarbons;

(8) combining said lower molecular weight hydrocarbons with said lights fraction in steps (3) and (4) to produce a combined stream; and (9) separating said combined stream into a light olefins stream comprising ethylene and propylene, a first side stream comprising primarily ethane and propane, a second side stream comprising butanes, and a bottoms stream comprising $C_5$+ hydrocarbons.

14. A process according to claim 13 wherein said first hydrocarbon feed is gasoline.

15. A process according to claim 13 wherein said second hydrocarbon feed comprises naphtha.

16. A process according to claim 14 wherein said second hydrocarbon feed comprises naphtha.

17. A process for upgrading hydrocarbon feeds comprising the steps of:

(1) introducing a hydrocarbon feed stream comprising at least one non-aromatic hydrocarbon into an aromatization reactor, and contacting said feed stream with a zeolite-containing catalyst under effective reaction conditions to produce a first reactor effluent, comprising aromatic hydrocarbons and non-aromatic hydrocarbons;

(2) introducing said first reactor effluent into at least one first separator and separating said reactor effluent into (a) a lights fraction comprising primarily alkanes and alkenes containing less than 6 carbon atoms per molecule, (b) a middle fraction comprising primarily aromatic hydrocarbon containing 6 to 8 carbon atoms per molecule and (c) a $C_9$+ fraction comprising hydrocarbons containing more than 8 carbon atoms per molecule;

(3) introducing said middle fraction (b) into an aromatics extraction unit and separating said middle fraction into a non-aromatic hydrocarbons fraction and an aromatics fraction consisting essentially of BTX;

(4) introducing said non-aromatic hydrocarbons fraction obtained in step (3) into a thermal cracking reactor and converting said hydrocarbons contained in said non-aromatic hydrocarbons fraction to a second reactor effluent which comprises lower molecular weight hydrocarbons;

(5) combining said second reactor effluent from said thermal cracking reactor in step (4) with the lights fraction (a) obtained in step (2) to produce a first combined stream; and (6) introducing said first combined stream obtained in step (5) into at least one second separator and separating said first combined stream into an overhead stream comprising primarily ethylene and propylene, a first side stream comprising primarily ethane and propane, a second side stream comprising primarily butanes, and a bottoms stream comprising hydrocarbons containing 5 or more than 5 carbon atoms per molecule.

18. A process according to claim 17 wherein said first hydrocarbon feed is gasoline.

19. A process according to claim 17 wherein said first side stream obtained in step (6) is combined with said non-aromatic fraction obtained in step (3) to produce a second combined stream and introducing said first combined stream into said thermal cracking reactor used in step (4).

20. A process according to claim 19 wherein said second combined stream further comprising a fresh alkane feed.

21. A process according to claim 18 wherein said first side stream obtained in step (6) is combined with said non-aromatic fraction obtained in step (3) to produce a second combined stream and introducing said first combined stream into said thermal cracking reactor used in step (4).

22. A process according to claim 21 wherein said second combined stream further comprising a fresh alkane feed.

23. A process according to claim 17 further comprising said bottoms stream with said hydrocarbon feed stream used in step (1) to produce a third combined stream and introducing said third combined stream into the aromatization reactor in step (1).

24. A process for upgrading hydrocarbon feeds comprising the steps of:

(1) introducing a first hydrocarbon feed stream comprising at least one non-aromatic hydrocarbon into an aromatization reactor, and contacting said first feed stream with a zeolite-containing catalyst under effective reaction conditions to produce a first product stream comprising aromatic hydrocarbons and non-aromatic hydrocarbons;

(2) introducing a second hydrocarbon feed stream comprising at least one non-aromatic hydrocarbon into a reforming reactor and contacting said second hydrocarbon feed with a Group VIII metal or a Group VIII metal-containing, catalyst under an effective condition to produce a second product stream comprising aromatic hydrocarbons and non-aromatic hydrocarbons;

(3) introducing said first product stream into at least one first separator and separating said first product stream into (a) a lights fraction comprising primarily alkanes and alkenes containing less than 6 carbon atoms per molecule, (b) a middle fraction comprising primarily aromatic hydrocarbons containing 6–8 carbon atoms per molecule, and (c) a $C_9$+ fraction comprising hydrocarbons containing more than 8 carbon atoms per molecule;

(4) introducing said second product stream into at least one second separator and separating said second product stream into (i) a lights fraction comprising primarily alkanes and alkenes containing less than 6 carbon atoms per molecule, (ii) a middle fraction comprising primarily aromatic hydrocarbons containing 6–8 carbon atoms per molecule, and (iii) a $C_9$+ fraction comprising primarily hydrocarbons containing more than 8 carbon atoms;

(5) combining said middle fraction (a) obtained in step (3) with said middle fraction (ii) obtained in step (4) to product a combined middle fraction;

(6) introducing said combined middle fraction into an aromatics extraction unit and separating said combined stream into a non-aromatic hydrocarbons fraction and an aromatic hydrocarbons fraction consisting essentially of BTX;

(7) introducing said non-aromatic hydrocarbons fraction into a thermal cracking reactor and producing a reactor effluent lower molecular weight hydrocarbons;

(8) combining said reactor effluent with said lights fraction (a) obtained in step (3) to produce a first combined stream; and (9) introducing said first combined stream into at least one third separator and separating said first combined stream into an overhead stream comprising primarily ethylene and propylene, a first side stream comprising primarily ethane and propane, a second side stream comprising primarily butanes and butenes, and a bottoms stream comprising hydrocarbons containing 5 or more than 5 carbon atoms per molecule ($C_5$+ hydrocarbons).

25. A process according to claim 24 wherein said first hydrocarbon is gasoline and said second hydrocarbon feed comprises naphtha.

26. A process according to claim 25 wherein said second hydrocarbon feed comprises hydrotreated naphtha.

27. A process according to claim 26 wherein said first separator, second separator, and third separator each comprises a plurality of fractional distillation units.

28. A process according to claim 24 further comprising combining said first side stream obtained in step (9) with said non-aromatic hydrocarbons fraction obtained in step (3) to produce a second combined stream and introducing said second combined stream into said thermal cracking reactor used in step (7).

29. A process according to claim 28 wherein said second combined stream further comprising a fresh alkane feed.

30. A process according to claim 25 further comprising combining said first side stream obtained in step (9) with said non-aromatic hydrocarbons fraction obtained in step (3) to produce a second combined stream and introducing said second combined stream into said thermal cracking reactor used in step (7).

31. A process according to claim 26 wherein said second combined stream further comprising a fresh alkane feed.

32. A process according to claim 28 wherein said alkane is pentane.

33. A process according to claim 24 further comprising said bottoms stream with said hydrocarbon feed stream used in step (1) to produce a third combined stream and introducing said third combined stream into the aromatization reactor in step (1).

34. A process according to claim 28 further comprising said bottoms stream with said hydrocarbon feed stream used in step (1) to produce a third combined stream and introducing said third combined stream into the aromatization reactor in step (1).

35. A process according to claim 24 further comprising combining said $C_9$+ fraction obtained in step (3) with said $C_9$+ fraction (iii) obtained in step (4) to produce a combined $C_9$+ hydrocarbon product stream.

* * * * *